US007971413B2

(12) United States Patent
Lanfranchi

(10) Patent No.: US 7,971,413 B2
(45) Date of Patent: Jul. 5, 2011

(54) PROCESS AND AUTOMATIC SYSTEM FOR ORDERLY PACKAGING OF PLASTIC PREFORMS IN CARTON BOXES

(75) Inventor: Lino Lanfranchi, Collecchio (IT)

(73) Assignee: Lanfranchi S.r.l., Collecchio (IT)

( * ) Notice: Subject to any disclaimer, the term of this patent is extended or adjusted under 35 U.S.C. 154(b) by 0 days.

(21) Appl. No.: 12/066,081

(22) PCT Filed: Sep. 8, 2006

(86) PCT No.: PCT/EP2006/008768

§ 371 (c)(1),
(2), (4) Date: Mar. 7, 2008

(87) PCT Pub. No.: WO2007/031238

PCT Pub. Date: Mar. 22, 2007

(65) Prior Publication Data

US 2008/0223002 A1 Sep. 18, 2008

(30) Foreign Application Priority Data

Sep. 12, 2005 (IT) ..... PR2005A0050

(51) Int. Cl.
*B65B 5/08* (2006.01)

(52) U.S. Cl. ..... 53/246; 53/247; 53/260; 53/536

(58) Field of Classification Search ..... 53/448, 53/475, 236, 245, 246, 247, 250, 260, 535, 53/536, 540; 493/90, 91, 92
See application file for complete search history.

(56) References Cited

U.S. PATENT DOCUMENTS

| | | | | | |
|---|---|---|---|---|---|
| 3,753,509 | A | * | 8/1973 | Kock | 53/247 |
| 4,233,802 | A | * | 11/1980 | Booth et al. | 53/475 |
| 4,325,208 | A | * | 4/1982 | Barker | 53/448 |
| 4,385,482 | A | * | 5/1983 | Booth | 53/247 |
| 4,567,712 | A | | 2/1986 | Varallo et al. | |
| 4,776,148 | A | * | 10/1988 | Mingozzi | 53/538 |
| 4,829,747 | A | * | 5/1989 | Johnson et al. | 493/91 |
| 4,901,504 | A | * | 2/1990 | Tsuji et al. | 53/247 |
| 5,063,334 | A | * | 11/1991 | Tanita et al. | 318/568.1 |
| 5,611,193 | A | * | 3/1997 | Farrelly | 53/475 |
| 5,778,640 | A | * | 7/1998 | Prakken et al. | 53/475 |
| 6,128,886 | A | * | 10/2000 | Johnson et al. | 53/445 |
| 6,209,293 | B1 | * | 4/2001 | Powers | 53/475 |
| 6,860,088 | B2 | * | 3/2005 | Goodman | 53/443 |
| 6,918,233 | B2 | * | 7/2005 | Roy et al. | 53/448 |
| 7,219,485 | B2 | * | 5/2007 | Battisti | 53/448 |
| 7,302,785 | B2 | | 12/2007 | Heuvel et al. | |

FOREIGN PATENT DOCUMENTS

EP 1 544 113 A1 6/2005

* cited by examiner

*Primary Examiner* — Christopher Harmon
(74) *Attorney, Agent, or Firm* — Young & Thompson

(57) ABSTRACT

An automatic system for orderly packaging of plastic preforms in carton boxes includes a manipulator unit (6) having a vacuum gripping head (23) and one or more units (10) for handling and inserting separators (12) in the carton box (13) to be filled. The head (23) includes a plurality of compartments (30) conforming to the shape of the preforms (2) whereas the separator (12) has a plurality of partitions (12*a*) parallel to one of its sides and equally spaced at a distance at least corresponding to the length of the preform (2).

8 Claims, 4 Drawing Sheets

Detail A

FIG. 5
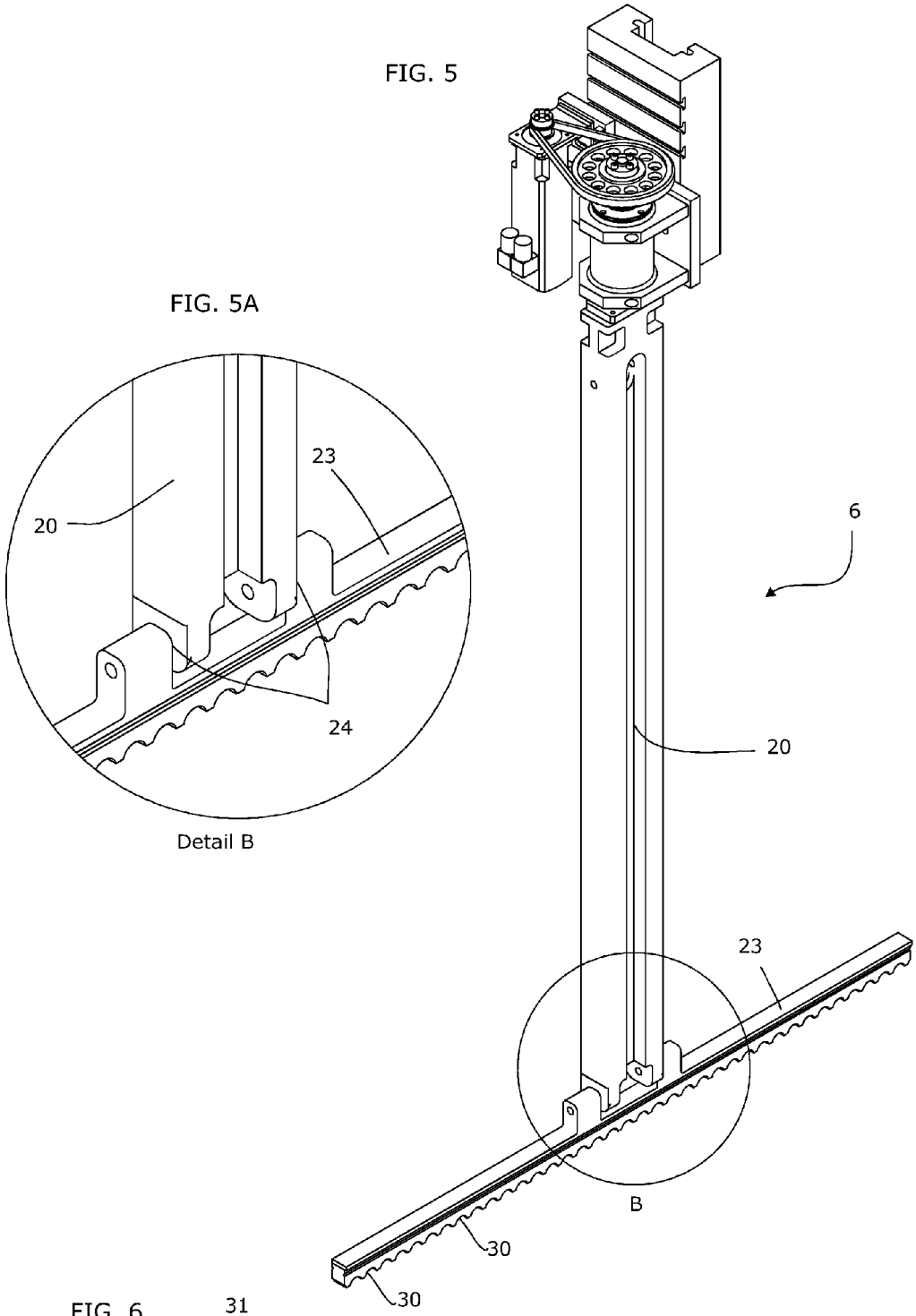
FIG. 5A
Detail B
FIG. 6
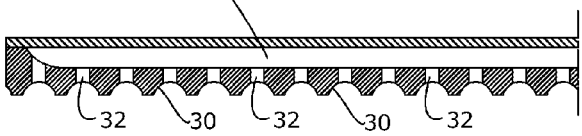

PROCESS AND AUTOMATIC SYSTEM FOR ORDERLY PACKAGING OF PLASTIC PREFORMS IN CARTON BOXES

FIELD OF THE INVENTION

This invention relates to a process and an automatic system for orderly packaging of plastic preforms in carton boxes.

Plastic containers and particularly PET bottles are blow molded from special molded preforms or parisons.

Preform molding machines are not always located in the same factories as the blowing machines and since the output rate of such preform molding machines is often different from the output rate of the blowing machines, preforms have to be stored and carried in carton boxes having a parallelepipedal shape or a prismatic shape with an octagonal base.

As is known, plastic preforms are molded and, as the molds of the machine are opened, they fall onto a belt conveyor which carries them into the carton box.

Once the preforms have fallen in the box by gravity, they are stored therein in bulk arrangement.

The drawbacks of prior art are:

high handling costs, which increase the preform unit cost;

the preforms fall one above the other and, due to the considerable height of the boxes as compared with preform sizes, they are subjected to surface damaging and cracking, which leads to high bottle or container reject rates.

In an attempt to obviate the above drawbacks, the prior art has proposed a process and a system, as described and shown in Italian Patent 1280729.

In the process for filling carton boxes as disclosed in the above patent, one or more filling tubes or sleeves are introduced in the carton box, and may be handled and positioned therein.

The tubes are filled with preforms.

The boxes are held in an inclined position, so that filling occurs from the bottom and from a side of the carton box, by unloading the preform-filled tubes.

The carton box is filled by successive tube handling operations in the current filling position, using a programmable-logic controller, which allows filling to occur with a substantially matrix arrangement.

This process and system also have certain drawbacks, e.g.:

all the sleeves have to be replaced when the preform size changes;

the preforms are likely to become jammed in the sleeves due to the conformation of preform necks, which cause them to incline with respect to the sleeve axis;

the preforms are always inserted in the same direction, with the necks of one layer adjacent to the necks of the next layer, thereby reducing the available space.

SUMMARY OF THE INVENTION

The object of this invention is to provide fast and safe packaging of preforms regardless of their size and to optimize the available space in carton boxes.

The advantages achieved thanks to the process and system of this invention consist in a considerable reduction of handling costs and in lower preform reject rates.

These objects and advantages are achieved by the process and system for orderly packaging of plastic preforms in carton boxes according to this invention, which is characterized by the annexed claims.

BRIEF DESCRIPTION OF THE DRAWINGS

This and other features will be more apparent from the following description of a preferred embodiment, which is shown by way of example and without limitation in the accompanying drawings, in which:

FIG. 5 is an isolated view of the preform manipulator in another operating configuration thereof;

FIG. 5*a* shows a detail of the manipulator unit of FIG. 5;

FIG. 6 is a sectional view of the gripping head.

DETAILED DESCRIPTION OF THE DRAWINGS

Figure 1:
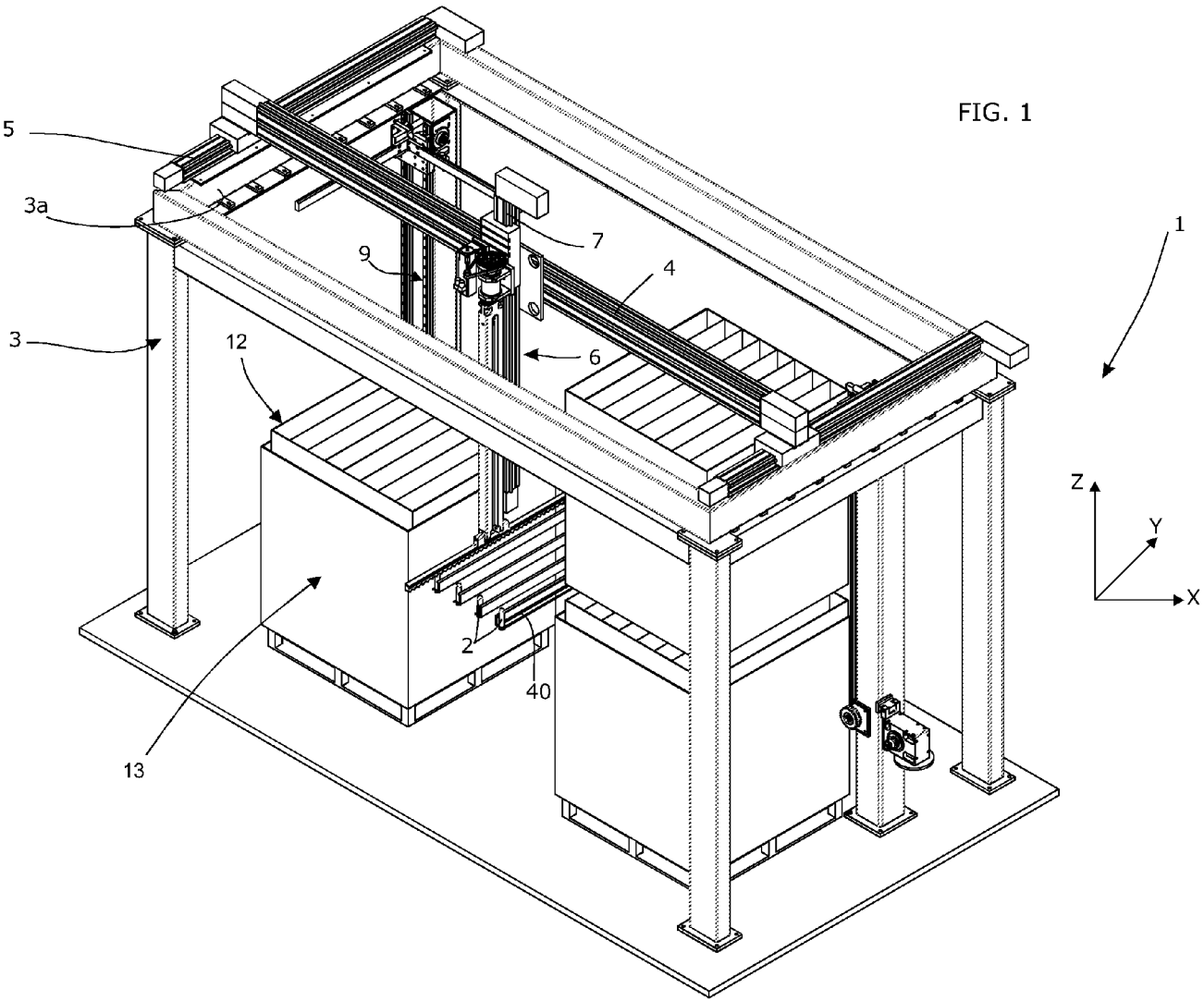
FIG. 1 is a perspective view of the automatic system for palletizing plastic preforms.

Referring to FIG. 1, numeral 1 generally designates an automatic system for palletizing plastic preforms, also known as "parisons" and designated by numeral 2 in the example.

The system 1 is composed of a portal frame 3 on which a horizontal carriage 4 slides in guides 5 (which are stationary relative to the stringers 3*a*).

A manipulator unit 6 is fitted to the carriage 4, and slides in a vertical guide 7.

With reference to the Cartesian coordinate system xyz, the guides 5 allow displacement of the manipulator unit 6 in the y direction, the horizontal carriage allows displacement thereof in the perpendicular direction x and the guide 7 allows displacement thereof in the z direction.

Thus, the manipulator unit 6 may be easily moved to any point within the frame, along the above Cartesian coordinates.

Figure 2:
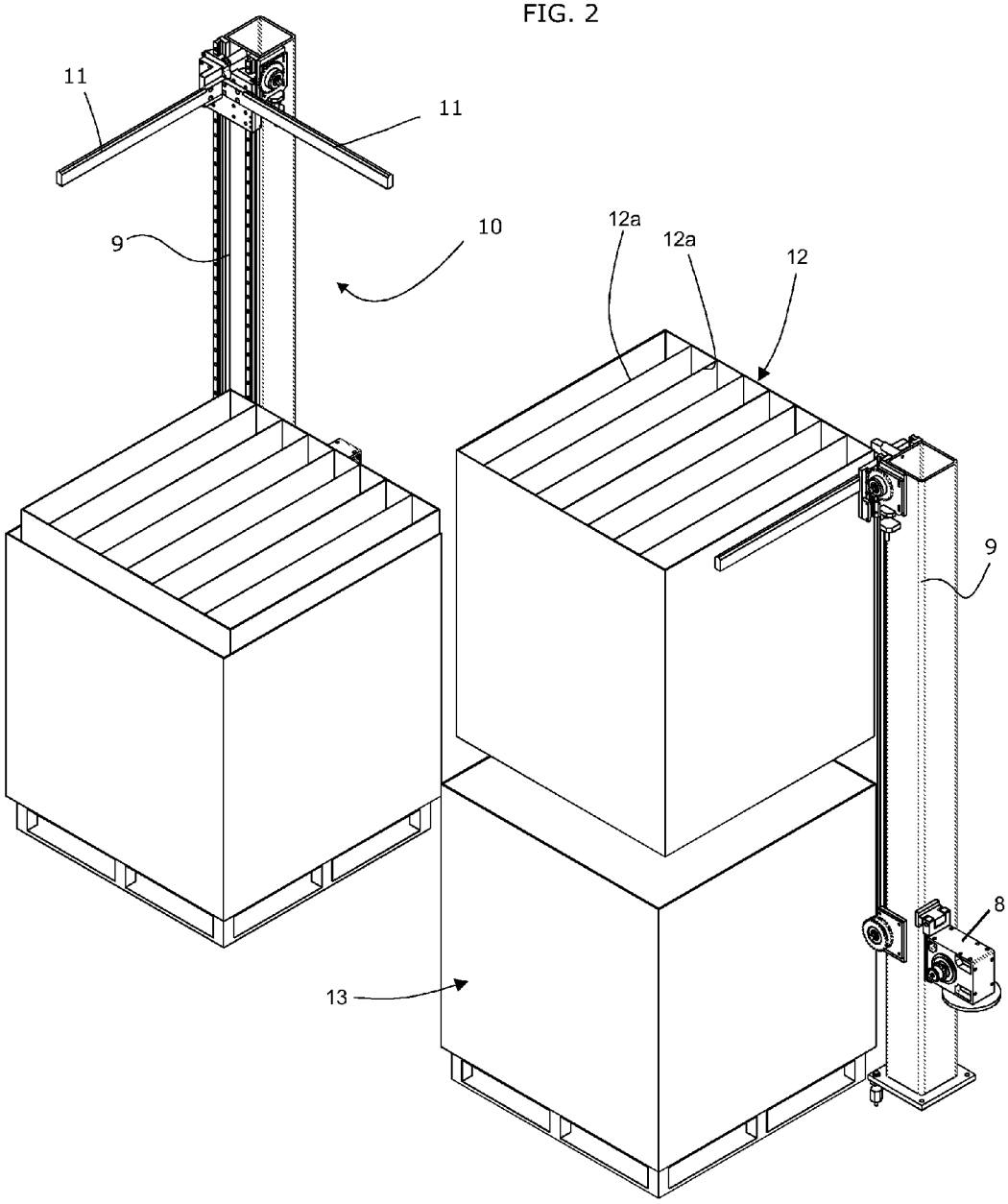
FIG. 2 is an isolated view of the unit for introducing separators in the system of FIG. 1.

Referring to FIG. 2, the portal 3 further has two posts 9, which are part of a unit 10 for handling and inserting separators 12, as described hereafter.

The posts 9 extend vertically, i.e. along the manipulator displacement direction along the z axis, and are secured to the basis of the portal frame 3 of the automatic palletizer system 1.

Each post is equipped with an electric motor 8 and a pair of orthogonal arms 11 extending along two adjacent sides to define—as viewed in a top view of the system 1—an "L" facing the inside of the portal 3.

The purpose of the arms 11 is to support the separators 12, which are appropriately attached thereto by known means, and to move them vertically, along the z direction, by the electric motor 8, that operates on the pair of arms 11 attached thereto by means of known mechanical drives, such as chains, toothed belts and rack and pinion mechanisms.

These separators 12 are box-like thin-walled elements, which are designed to be introduced in the carton boxes 13 in which the preforms 2 are to be inserted and palletized.

As shown, the separator 12 has a number of partitions 12*a*, parallel to one of its sides and equally spaced at such a distance as to allow the preform 2 to be perpendicularly inserted and received between two partitions 12*a* (which means that, after insertion, the axis 2*a* of the preform 2 is perpendicular to the plane of the wall 12*a*).

The system 1 has two separator inserting units 10, so that, during palletization on a carton box, an operator can prepare the adjacent unit in safe conditions.

Particularly, the operator will place the empty carton box 13 on a pallet 14 in the right position within the system 1, obviously after lifting the corresponding separator 12.

Then, the separator 12 will be lowered along the post 9 and introduced in the carton box 13, where it will remain during the next preform 2 palletization step.

Once palletization is completed, the separator 12 is lifted again and the carton box filled with preforms is closed and carried away.

Figure 3:
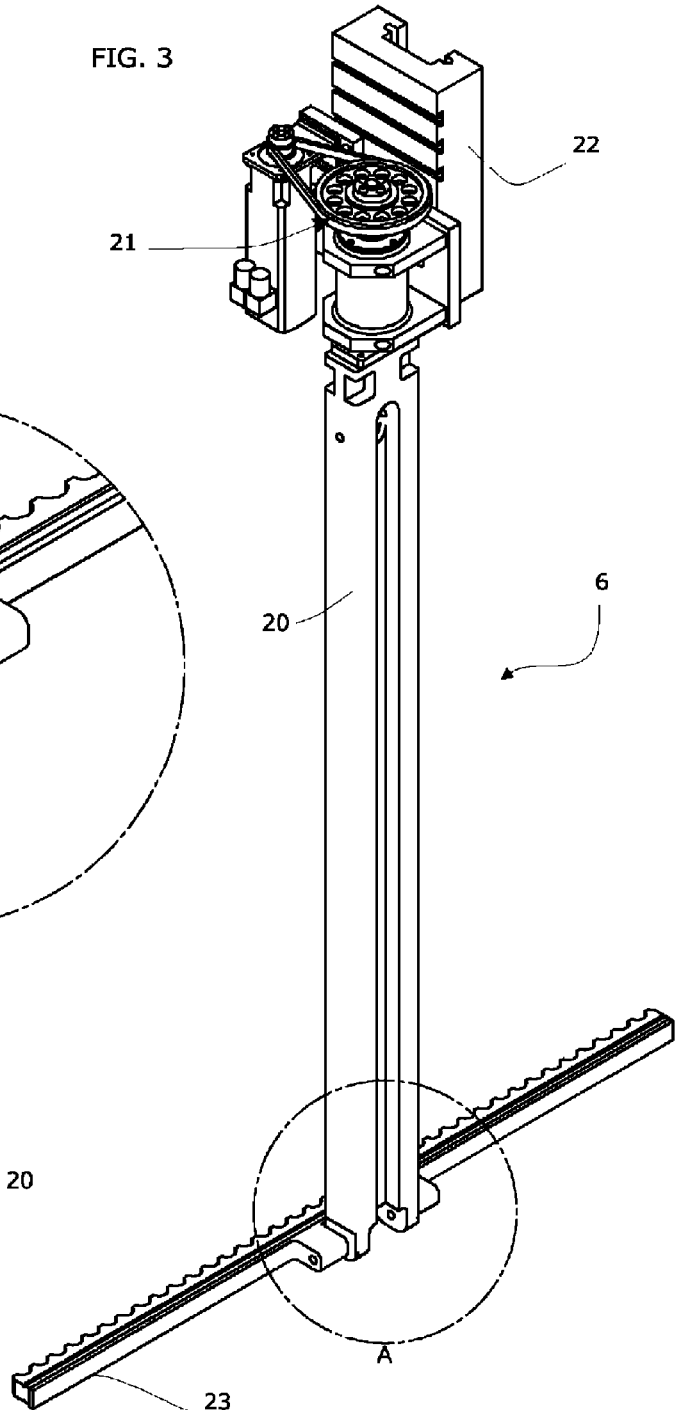
FIG. 3 is an isolated view of the preform manipulator in an operating configuration thereof.

The above palletization is performed by the manipulator unit 6 as shown in FIGS. 3 and 5.

The manipulator 6 consists of a vertically extending arm 20, which can rotate about its center axis thanks to an independent motor drive unit 21.

As mentioned above, the unit 6 is mounted to a carriage 22, which can be translated vertically (along the z axis) in a corresponding guide 7.

At its lower end, the arm 20 has a head 23 which is hinged at corresponding hinge points 24, allowing it to rotate about said hinge points.

FIGS. 3, 5, 3*a* and 5*a* show two possible positions of the head 23, the former being orthogonal to the direction of the arm 20, the latter being parallel thereto.

Figure 4:
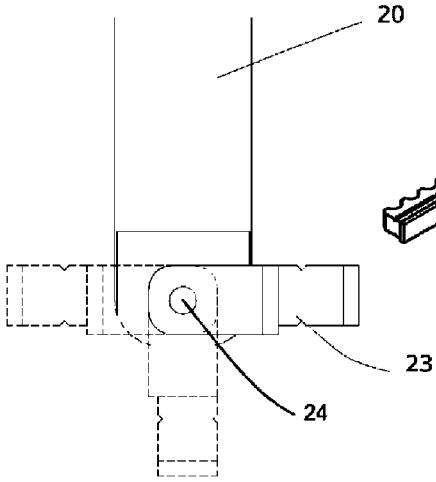
FIG. 4 shows various possible positions of the gripping head of the manipulator.

FIG. 4 shows that the head 23 may be also set in mirror positions, more particularly at angles of ±90° with respect to the vertical defined by the extension of the arm 20.

The head 23 is positioned by well-known means, not shown herein; according to one embodiment of the head 23 rotating device, two parallel sprockets are mounted both on the head 23 and on the arm 20 and are connected by a toothed belt; such belt may be actuated by a hydraulic cylinder mounted on the arm 20 which operates on the belt on both belt moving directions, thereby causing the desired rotation in both directions.

Back to the figures, the head 23 is shown as having a plurality of compartments 30 approximately conforming to the shape of the preform 2 to be gripped.

As shown in FIG. 6, the head 23 has a cavity 31 therein, and each compartment 30 has a hole 32 connected to said cavity 31.

The purpose of this cavity 31 is to create negative pressure in the adjacent compartments 30, whereby, in known system mounting conditions, vacuum may be generated in the cavity 31 to turn the head 23 into a preform 2 suction head.

The preforms 2 shall be thus conveyed to a pick-up station, by conveyor means, designated by numeral 40 in FIG. 1.

Figure 3A:
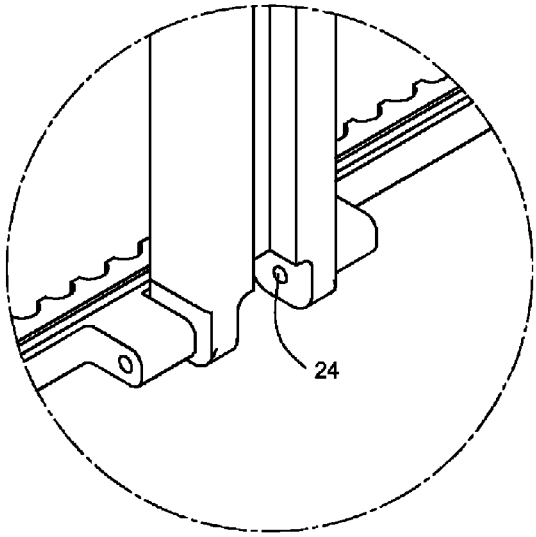
FIG. 3*a* shows a detail of the manipulator unit of FIG. 3.

More particularly, the preforms 2 are received vertically on the conveyors, where they accumulate in a stacked arrangement for pick-up; this occurs by moving the head 23, in the rotated position of FIG. 3*a* (or a position opposite thereto), toward the stack of preforms 2 ready to be sucked: as the vacuum system is actuated, the preforms 2 are attracted and firmly held against the head 23.

A control system controls the whole palletization step, by moving the manipulator 6 with the preforms attached thereto over the carton box to be filled, so that the head 23 is parallel to the direction of the walls 12*a* of the separator 2.

Now, the head 23 is rotated so that the previously vertical preforms 2 are oriented horizontally, ready to be inserted between two partitions 12*a*.

The arm 6 may be then lowered into the separator and vacuum may be relieved to release the preforms 2 in the carton box.

Operation continues as described above for each row of compartments of the separators 12 until the carton box is filled.

The process continues as described above.

While reference has been made in this example to preforms 2 being laid vertically, the palletization system also operates with preforms 2 arranged at different angles.

The head 23 will be thus positioned in such a manner as to be able to properly pick up and suck the preforms 2.

The preforms 2 may be also released in a position other than the horizontal position.

This is particularly useful for carton boxes having a prismatic shape with an octagonal base (ottobin), which are currently widely used: in this case, an appropriately sized separator is positioned as desired in the carton box, whereas the remaining free spaces, in which the gripping head 23 cannot be inserted, will receive the preforms 2 by free fall from the head, either in a vertical or horizontal position.

The invention claimed is:

1. An automatic system (1) for orderly packaging of plastic preforms (2) in carton boxes, comprising:

a manipulator unit (6) consisting of a vertically extending arm (20) in which at a lower end of the arm (20) is a vacuum gripping head (23), said vacuum gripping head (23) having a plurality of compartments (30) conforming to a shape of the preform (2) to be gripped;

one or more units (10), each of the units (10) adapted for handling and inserting separators (12) in the carton box (13) to be filled, each separator (12) having a plurality of partitions (12*a*) parallel to one side of the separator and equally spaced at a distance at least corresponding to a length of the preform (2), wherein said vacuum gripping head (23) is hinged at corresponding hinge points (24) located in the lower end of the arm (20) so that the vacuum gripping head (23) can rotate about the hinge points (24) at angles of ±90° with respect to a vertical defined by the extension of the arm (20) in order to pick up the preform (2) in a vertical position and to orient the preform (2) horizontally, ready to be inserted between two partitions (12*a*), and the control arm (20) has an independent motor drive unit (21) which allows the control arm (20) to rotate about a longitudinal axis of said control arm (20).

2. the automatic system (1) as claimed in claim 1, wherein the gripping head (23) has a cavity (31) therein, which is connected to each compartment (30) through holes (32), said system further comprising a vacuum generator for generating vacuum in the cavity (31).

3. the automatic system (1) as claimed in claim 1, wherein each unit (10) for inserting separators (12) comprises a vertically extending post (9), and a pair of arms (11) driven by an electric motor (8), which support the separator (12), whose two sides are secured to the above arms (11).

4. the automatic system (1) as claimed in claim 3, wherein the arms (11) extend orthogonally to one another to define an L-shape facing the inside of a portal (3).

5. The automatic system (1) as claimed in claim 3, wherein the electric motor (8) operates on the pair of arms (11) by usage of mechanical drives, causing the arms (11) to be vertically displaced.

6. the automatic system (1) as claimed in claim 1, wherein the manipulator unit (6) is mounted to a carriage (22) allowing vertical translational motion, the carriage (22) being engaged in a guide (7), said guide (7) being in turn mounted to a horizontal carriage (4) perpendicular thereto; said horizontal carriage (4) being engaged in guides (5) on a portal frame (3) of the system (1).

7. the automatic system as claimed in claim 1, wherein the system comprises a system for controlling the manipulator (6) and palletization operations of the manipulator.

8. An automatic system (1) for orderly packaging of plastic preforms (2) in carton boxes, comprising:

a) a manipulator unit (6), having a vacuum gripping head (23) attached to a control arm (20), said head (23) comprising a plurality of compartments (30) conforming to a shape of the preforms (2) and being pivotally mounted for movement over an angular range with respect to an axis of the control arm (20) sufficient to pick up a preform in a vertical position and to orient the preform horizontally, ready to be inserted between two partitions;

b) one or more units (10), each of the units (10) is for handling and inserting separators (12) in the carton box (13) to be filled, each separator (12) having a plurality of partitions (12*a*) parallel to one side of the separator and equally spaced at a distance at least corresponding to a length of the preform (2), wherein the control arm (20) has an independent motor drive unit (21) which allows the control arm (20) to rotate about a longitudinal axis of said control arm (20), and said vacuum gripping head (23) is mounted at a lower end of said manipulator unit to corresponding hinge points (24), allowing the head (23) to rotate about said hinge points.

* * * * *